United States Patent [19]

Ilmoniemi et al.

[11] 4,179,332

[45] Dec. 18, 1979

[54] APPARATUS FOR DAMPING PRESSURE AND CONSISTENCY PERTURBATIONS IN A PULP SUSPENSION FLOW

[75] Inventors: Erkki Ilmoniemi, Vaajakoski; Olavi Kokkonen, Jyväskylä, both of Finland

[73] Assignee: Valmet Oy, Finland

[21] Appl. No.: 918,948

[22] Filed: Jun. 26, 1978

[30] Foreign Application Priority Data

Jul. 1, 1977 [FI] Finland ..... 772075

[51] Int. Cl.[2] ..... D21F 1/06

[52] U.S. Cl. ..... 162/380; 137/207; 138/26

[58] Field of Search ..... 162/340, 380; 137/207; 138/26; 417/543

[56] References Cited

U.S. PATENT DOCUMENTS 2,896,862 7/1959 Bede ..... 137/207 X

*Primary Examiner*—Richard V. Fisher

*Attorney, Agent, or Firm*—Steinberg & Blake

[57] ABSTRACT

Apparatus for damping pressure and consistency perturbations occurring in the pulp suspension flow to the headbox of a paper making machine including an enclosed damping tank defining therewithin a space for a volume of air and a space for the pulp suspension such that the pulp suspension and the air volume have direct interfacing contact. Longitudinally extending distribution and collecting header means are disposed within the tank for conducting the flow of pulp suspension into and out of the tank, respectively. Each of the distribution and collecting header means define a flow passage for the pulp suspension, which passages fluidly communicate with the pulp suspension space within the damping tank through an elongate, continuous slit. Damping or attenuation of the pressure perturbations in the pulp stock flow is achieved through the interaction of the surface of the pulp stock with the air volume while the consistency perturbations are damped through the action of a plural delay principle.

3 Claims, 4 Drawing Figures

APPARATUS FOR DAMPING PRESSURE AND CONSISTENCY PERTURBATIONS IN A PULP SUSPENSION FLOW

BACKGROUND OF THE INVENTION

This invention relates generally to an apparatus for damping perturbations in pulp suspension flow and, more particularly, to an apparatus for damping pressure and consistency perturbations in the pulp suspension flow to the headbox of a paper making machine.

Conventional paper making machines typically include a headbox which receives a flow of a pulp suspension and delivers the same to the web former section of the machine. Of course, it is desired that the quantity of dry matter in the pulp system issued from the aperture of the headbox be uniform over the length of the aperture as well as uniform per unit of time.

Thus, if the flow rate is uniform over the length of the headbox aperture but varies with respect to time, this will result in variation in the dry weight of the paper manufactured in the direction in which the web is formed in the machine. Such variations in the dry weight content of the pulp per unit time may be caused by the variations of the volume flow rate of the pulp to the headbox, by the pressure waves which are propagated at the velocity of sound and which are always present in the tube which feeds to the headbox, which pressure waves manifest themselves as variations in the kinetic energy of the pulp emanating from the headbox and, thirdly, by large scale consistency variations in the pulp suspension supply tube associated with the headbox. In this connection, it should be noted that the initial portion of the former section of the paper machine serves to deform the pulp suspension layer discharged onto it.

If the pulp suspension flow emanating from the aperture of the headbox is constant in time but varies in dry matter content along the length of the headbox aperture, a variation in the transverse direction in the dry weight of the manufactured paper results. It is well known that such variations may be adjusted by regulating the lip of the headbox by means of fine adjustment mechanisms.

In some cases there will be no variations in the dry matter content of the pulp suspension over the length of the headbox aperture and the dry matter content of the pulp suspension will also be uniform on an average basis defined over a prolonged period of time. However, in such cases, it is not unusual for the dry matter content of the pulp suspension to differ from one moment to another. In such cases, the paper produced from the pulp suspension has heavier and lighter areas randomly dispersed over the area of the paper. Such variations are commonly termed residual variations. Such variations are caused both by the influence of turbulence vortices arising in the pulp suspension flowing out of the headbox and, also, by the non-uniform distribution, on a smaller scale, of the dry matter content of the pulp suspension.

It has been found that the magnitude or amplitude of the variations in the weight per unit area in the manufactured paper depends upon the intensity or amplitude of the perturbations generated by the forces of the disturbances which give rise to these perturbations as well as to the capability of the particular pulp suspension delivery system to attenuate, or in some cases to amplify, the perturbations having the various frequencies which either enter the system or are generated therein.

Thus, the large scale consistency variations which are characterized by low frequency perturbations can be damped or attenuated using known consistency control apparatus. Since such consistency control apparatus are of a nature that they are relatively slow to act and, furthermore, since new consistency perturbations are produced at the point where the pulp suspension is mixed prior to entering the headbox, it is desirable to provide a passive damping mechanism in the pulp suspension delivery system prior to the headbox.

An apparatus for damping such pressure and consistency perturbations has previously been developed by the applicant. This apparatus comprises an equalizing tank located in the approach pipe system, the tank providing an air cushion for the pulp suspension which is fed into and out of the tank in accordance with a plural delay principle which serves to attenuate at least the consistency perturbations and has been dimensioned in accordance with the frequency spectra of the perturbations as well as with a view toward the attenuation of such perturbations. Thus, this equalizing tank comprises a preferably horizontal cylindrical shell and cooperates with uniformly spaced input and output pipes for the pulp suspension located on opposite sides of the tank and which are arranged in accordance with the plural delay principle which is used in the prior apparatus. The input and output pipes are preferably connected to conical shaped collecting tubes which direct the inflow and outflow of the pulp suspension in mutually opposed directions.

It has been found that the operation of the above-described apparatus has not been entirely satisfactory. Thus, as mentioned above, in this previously designed damping apparatus the distribution header and the collecting header are connected by pipes provided at appropriate intervals with the equalizing tank. The structure of this apparatus, in addition to being relatively complex, has the principle drawback that where the consistency perturbations in the pulp suspension flowing through the distribution header have a wave length approximating the spacing of the header connecting pipes, it has been found that such perturbations will not be significantly attenuated.

SUMMARY OF THE INVENTION

Accordingly, one object of the present invention is to provide new and improved apparatus for damping pressure and consistency disturbances or perturbations in the flow of a pulp suspension.

Another object of the present invention is to provide new and improved apparatus for damping pressure and consistency perturbations in the flow of a pulp suspension to a headbox of a paper making machine.

Still another object of the present invention is to provide apparatus for damping pressure and consistency disturbances in the flow of a pulp suspension which is relatively simple and inexpensive in manufacture.

Yet another object of the present invention is to provide such damping apparatus capable of attenuating pressure and consistency perturbations over a wide range of frequencies.

Briefly, in accordance with these and other objects, apparatus is provided including an enclosed damping tank defining therewithin a space for a volume of air and for a pulp suspension such that the pulp suspension and air volume have direct interfacing contact. Distribution and collecting headers are located within the damping tank defining inlet and outlet pulp suspension flow passages, respectively. The flow passages fluidly communicate with the pulp suspension space within the damping tank through a substantially continuous slit.

DESCRIPTION OF THE DRAWINGS

A more complete appreciation of the invention and many of the attendant advantages thereof will be readily appreciated as the same becomes better understood by reference to the following detailed description when considered in connection with the accompanying drawings wherein.

DESCRIPTION OF THE PREFERRED EMBODIMENTS

Figure 1:
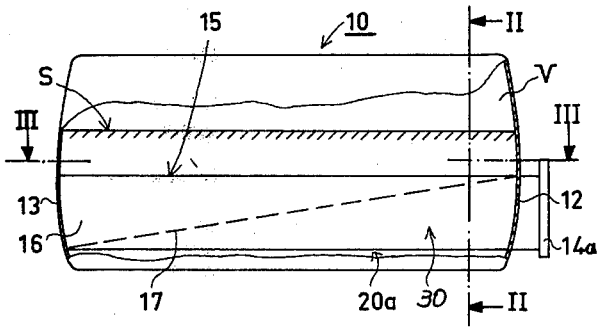
FIG. 1 is a side elevation view in partial section of the damping apparatus of the present invention.
Figure 2:
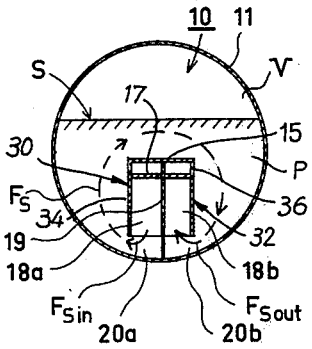
FIG. 2 is a sectional view of the damping apparatus taken along line II—II of FIG. 1.
Figure 3:
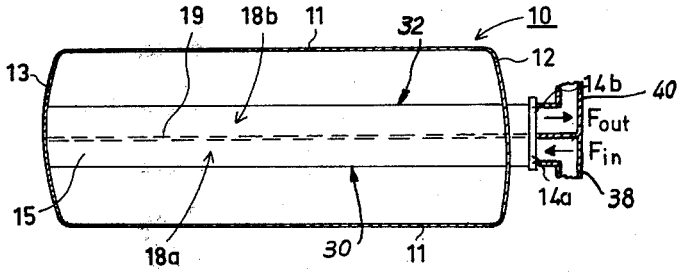
FIG. 3 is a sectional view of the damping apparatus taken along line III—III of FIG. 1.

Referring now to the drawings wherein like reference characters designate identical or corresponding parts throughout the several views and, more particularly, to FIGS. 1 through 3, the apparatus of the present invention includes a tank 10 comprising a cylindrical outer shell 11 enclosed at its ends by end walls 12 and 13. As described in detail hereinbelow, an opening is provided in end wall 12 for accommodating the distribution and collecting headers which extend therethrough. The dimensions of tank 10 are determined in accordance with the flow rate of the pulp suspension so as to provide a space or volume V for an air cushion against which the free surface, designated S, of the pulp suspension, designated P, circulating within tank 10 interfaces as will be described in greater detail hereinbelow. The direct interfacing of the free surface S of the pulp suspension P with the air cushion in space V serves to attenuate or damp the pressure perturbations present in the pulp suspension flow.

In order to achieve damping of the consistency perturbations in the pulp suspension flow, apparatus, described below, is associated with tank 10 for introducing and extracting the pulp suspension to and from damping tank 10 in accordance with the above mentioned plural delay principle.

Thus, in accordance with the present invention, a distribution header 30 and a collecting header 32 extend within tank 10 along substantially its entire length for introducing and withdrawing the pulp suspension to and from tank 10. The distribution and collecting header 30, 32 are defined by a pair of longitudinally extending vertical side walls 34, 36, each preferably having their one ends fixed to end wall 13 with their other ends extending exteriorly from tank 10. A longitudinally extending horizontal top wall 15 interconnects the upper edges of side walls 34, 36 and has its end edges similarly affixed to tank end wall 13 at one end and extending exteriorly of tank 10 at the other end. A longitudinally extending vertical partition wall 19 is located between side walls 34, 36, the upper edge of partition wall 19 being fixed to the lower surface of top wall 15 along its length and, similarly, has its end edges affixed to tank end wall 13 at one end and extending exteriorly of tank 10 at the other end.

Referring to FIGS. 1 and 2, it is seen that the lower edges of side walls 34, 36 are spaced along their lengths from the inner surface of the cylindrical shell 11 thereby defining a pair of elongate, continuous slits **20*a*, 20*b***, respectively.

An upper wall 17 is provided between side walls 34, 36 with its side edges affixed thereto. Upper wall 17 inclines downwardly towards the left as seen in FIG. 1, its leftward end edge being affixed to end wall 13 of tank 10 and its rightward end edge being affixed to top wall 15 at the point at which top wall 15 exits from tank 10.

The distribution header 30 is defined by side wall 34, partition 19 and upper wall 17 while the collecting header 32 is defined by side wall 36, partition wall 19 and upper wall 17. The distribution header 30 defines an inlet flow passage **18*a* while the collecting header 30 defines an outlet flow passage 18*b*. The space 16 defined between upper wall 17 and top wall 15 remains empty. Referring to FIG. 1, it is seen that the cross sectional area of the inlet flow passage 18*a* defined by distribution header 30 substantially linearly decreases in the direction of the pulp suspension flow, i.e., from right to left as seen in FIG. 1, while the cross sectional area of the outlet flow passage 18*b* defined by collecting header 32 substantially linearly increases in the direction of the pulp suspension flow, i.e., from left to right as seen in FIG. 1. Flanges 14*a* and 14*b* are provided at the exterior open ends of distribution and collecting headers 30, 32**, respectively.

A connecting tube comprising a pipe 38 for the incoming pulp suspension flow, designated $F_{in}$ is connected via flange **14*a* to the inlet flow passage 18*a* of distribution header 30 and, similarly, a connecting tube comprising a pipe 40 for the outgoing pulp suspension flow, designated $F_{out}$ is connected via flange 14*b* with the outlet flow passage 18*b* of collecting header 32**.

In operation, the pulp suspension is directed into distribution header 30 and enters the space P within damping tank 10 through the elongate slit **20*a* as shown by the arrow in FIG. 2 designated $F_s$. The pulp suspension circulates through damping tank 10 as shown in FIG. 2 and enters into outlet flow passage 18*b* of collecting header 32 via slit 20*b*. Of course, during steady state operation, the quantity of pulp suspension entering tank 10 through distribution header 30 equals the quantity of pulp suspension exiting from the tank through collecting header 32**.

As noted above, the inlet flow passage **18*a* decreases in cross sectional area in the direction of pulp suspension flow while the cross sectional area of outlet flow passage 18*b*** increases in the direction of pulp suspension flow. Through this construction, a gradual, stepless attenuation of consistency perturbations is achieved according to the plural delay principle, referred to above.

It is seen that through this construction, wherein the distribution and collecting headers are accommodated within the damping tank, the construction of the apparatus is greatly simplified since the differential pressures existing between the flow passages and the interior of the damping tank is insignificant.

Figure 4:
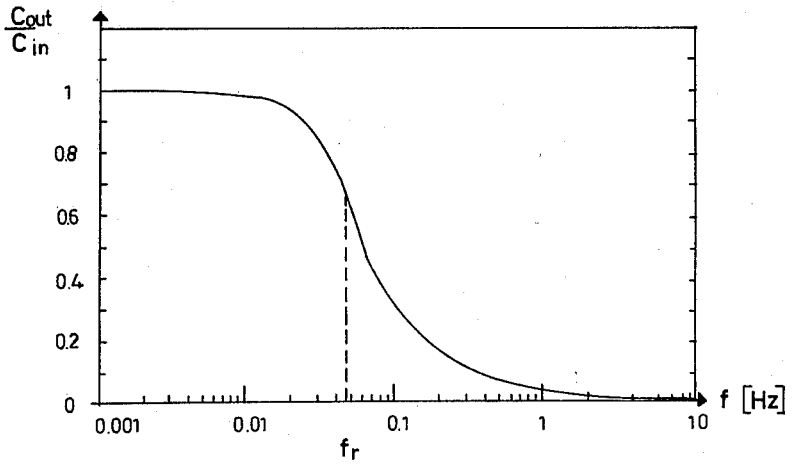
FIG. 4 comprises a graph illustrating the attenuation of consistency perturbations as a function of the frequency of such perturbations.

Referring to FIG. 4, a graph illustrates the relationship between the ratio of the amplitude of consistency perturbations in the pulp suspension flow departing from the damping apparatus of the present invention ($C_{out}$) to the amplitude of the consistency perturbations in the flow entering the apparatus ($C_{in}$) and the frequency of the consistency perturbations ($f_r$). Application of the so-called plural delay principle is implemented in the damping apparatus of the present invention when the pipes for the incoming and outgoing pulp suspension flow are connected to the same end of tank 10 as shown in the Figures. In such case, as shown in the graphic illustration of FIG. 4, an efficient (higher than 3dB) damping of the consistency perturbations is achieved at perturbation frequencies higher than $$f_r=0.45/T$$

In this formula, T represents the difference between the longest and shortest possible delay time of a liquid element entering the damping unit. Thus, if the velocity of the pulp suspension in the distribution header and in the collecting header is assumed to be the same (v) in the axial direction of the damping apparatus and if the length of the damping apparatus is L, then $$T=2L/v$$

Thus, referring to FIG. 4, it will be understood that the efficiency of the damping apparatus of the present invention in attenuating consistency perturbations increases with an increasing length of the damping apparatus and with decreasing velocity of flow in the distribution and collecting headers.

As mentioned hereinabove, in the damping apparatus previously designed by applicant, the distribution and collecting headers are connected to the tank by pipes provided at given intervals. As a consequence of this construction, those consistency perturbations having a wavelength in the distribution header approximating the spacing of the connecting pipes are not damped to any appreciable extent. The present invention provides the advantage that the distribution and collecting headers communicate with the interior of the tank through a continuous narrow slit 20, thereby eliminating the problem of the previously discussed apparatus.

Of course, it is understood that if it is desired to attenuate only the pressure and flow rate perturbations, i.e., where consistency perturbations are not damped, the pipes for the incoming and outgoing pulp suspension flow may, if desired, be situated at different ends of tank 10 with suitable modifications being made at the ends of the distribution and collecting headers.

Where the distribution header of the headbox (not shown) has a rectangular shape, it is advantageous to provide the associated connecting tube as a pipe for the outgoing pulp suspension flow with a similar rectangular shape so that the pulp suspension flow arrives in the headbox distribution header in a stable state. Thus, pipe 40 (FIG. 3) is preferably formed having a rectangular cross section.

Obviously, numerous modifications and variations of the present invention are possible in the light of the above teachings. It is therefore to be understood that within the scope of the appended claims the invention may be practiced otherwise than as specifically described herein.

What is claimed is:

1. Apparatus for damping pressure and consistency disturbances or perturbations in the flow of a pulp suspension to a headbox of a paper making machine, comprising:

an enclosed damping tank defining therewithin a space for a volume of air and a space for pulp suspension, such that said pulp suspension and air volume will have direct interfacing contact therebetween;

distribution header means disposed within said tank for conducting a flow of pulp suspension into said tank;

collecting header means disposed within said tank for conducting a flow of said pulp suspension out of said tank; and said distribution and collecting header means each defining pulp suspension flow passages, each of said flow passages being in fluid communication with said pulp suspension space within said damping tank through an elongate, continuous slit, said distribution and collecting header means being open at one side of said damping tank and being defined by an upper wall member, a pair of longitudinally extending side wall members and a longitudinally extending, substantially vertical partition member disposed between said side wall members, each elongate, continuous slit being defined by the lower edge of a respective side wall member and said damping tank.

2. Damping apparatus as recited in claim 1 wherein said flow passages have a substantially rectangular cross section and further including a connecting tube communicating with the flow passage defined by said distribution flow passage, said connecting tube having a substantially rectangular cross section whereby a stable flow of pulp suspension is delivered to said headbox.

3. Damping apparatus as recited in claim 1 wherein said pulp suspension flow passages defined by said distribution and collecting header means each have substantially rectangular cross sections and said upper wall member is inclined such that the cross sectional area of the flow passage defined by said distribution header means substantially linearly decreases in the direction of suspension flow from said one side of said damping tank and the cross sectional area of the flow passage defined by said collecting header means substantially linearly increases in the direction of suspension flow to said one side of said damping tank.

* * * * *